United States Patent [19]

Croese

[11] 3,965,841

[45] June 29, 1976

[54] METHOD FOR HAULING A VESSEL ALONGSIDE A MOORING PLATFORM

[76] Inventor: Hendrik Magchiel Willem Croese, Schiedamseweg 103, Vlaardingen, Netherlands

[22] Filed: Sept. 30, 1974

[21] Appl. No.: 510,729

[30] Foreign Application Priority Data

Apr. 26, 1974 Netherlands ..... 7405675

[52] U.S. Cl. ..... 114/230; 254/185 B

[51] Int. Cl.[2] ..... B63B 21/00

[58] Field of Search ..... 114/230, 235 R; 254/172, 185 R, 185 B

[56] References Cited

UNITED STATES PATENTS

| | | | |
|---|---|---|---|
| 247,680 | 9/1881 | O'Hanlon | 114/230 |
| 1,221,012 | 4/1917 | Anderson | 114/230 |

FOREIGN PATENTS OR APPLICATIONS

| | | | |
|---|---|---|---|
| 1,394,983 | 3/1965 | France | 114/230 |
| 1,330,883 | 5/1963 | France | 114/230 |

*Primary Examiner*—Trygve M. Blix
*Assistant Examiner*—Jesus D. Sotelo
*Attorney, Agent, or Firm*—Diller, Brown, Ramik & Wight

[57] ABSTRACT

This relates to a method for positioning and hauling a vessel alongside a mooring structure wherein the vessel is connected to the mooring structure by two cables and the vessel is hauled by shortening one of the cables and lengthening the other of the cables utilizing rotating winches over which the cables are passed, and each of the winches is provided with two drive mechanisms, one of the drive mechanisms being for actuating the winches and the other of the drive mechanisms being for applying a substantially uniform cable tensioning torque on the winch, the other drive mechanisms being in the form of hydraulic motors which include high pressure and low pressure lines and a system for maintaining a substantially constant pressure within the lines.

11 Claims, 1 Drawing Figure

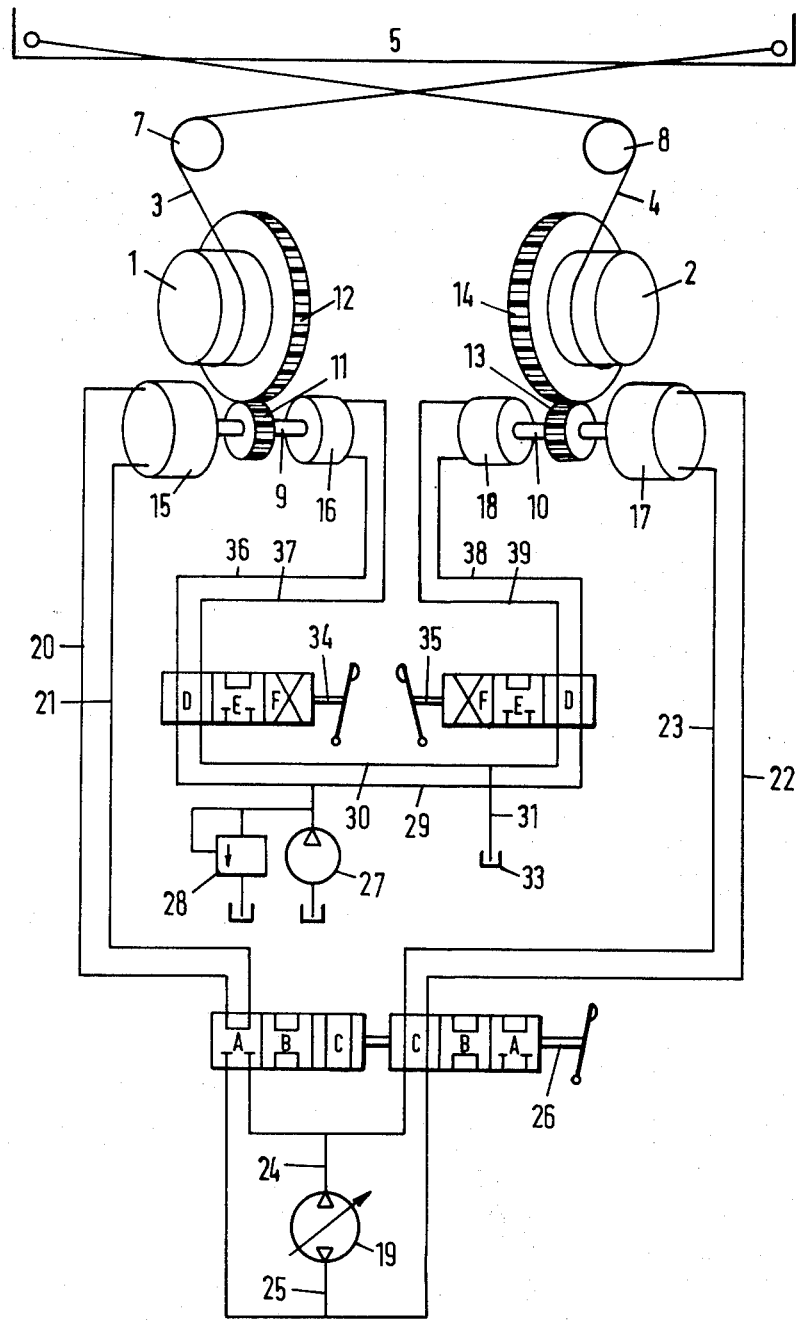
5
7
8
3
4
1
2
12
14
11
13
15
9
16
18
10
17
36
37
38
39
20
34
35
21
D
E
F
F
E
D
23
22
30
29
31
28
27
33
A
B
C
C
B
A
26
24
19
25

METHOD FOR HAULING A VESSEL ALONGSIDE A MOORING PLATFORM

The invention relates to a method for hauling a vessel alongside an anchored ship, a quay or similar stationary mooring platform, wherein at least two connections are made between the vessel and the mooring platform by means of cables and the vessel is hauled by shortening a connecting cable and lengthening another cable by rotating winches over which the cables are passed.

When a vessel, for instance a lighter, has to be loaded or unloaded, this can be done with a conveying means fixed on a mooring platform, while the vessel is either continuously or intermittently hauled along the mooring platform. For that purpose two cables secured near the forward end and at the stern of the vessel respectively, are generally used, which run to the mooring platform in mutually crossing relationship where they are passed over rotatable winch drums either through the intermediary of reversing rollers or not. When the vessel is hauled one of the winches will have to unwind, whereas the other winch winds. During that operation the unwinding winch has to be braked, for instance, mechanically or with the aid of a hydraulic brake valve so as to keep a specific tension on the cable in question.

When a vessel has to be hauled in a rapidly flowing river or in tidal water, only just a sufficient torque will have to be exerted to keep a tension on the cable in question when hauling with the winding winch has to be done in the same direction as the prevailing current, while the hauling is actually done by winding the other cable and braking at the same time. Each winch therefore has to be capable of both winding and unwinding under a heavy load. Furthermore each winch has to be capable of winding and unwinding under a heavy load, wherein a tension is kept on only the cable in question.

This invention aims at providing a method of hauling vessels wherein always a certain minimum tension is maintained on the cables.

According to the invention the cables are given a specific pretension by continuously exerting a torque on each winch independent of the other driving mechanism, said torque being exerted by means of a hydraulic motor, the motors being interconnected by a high and a low pressure line and wherein the pressure in the high and the low pressure line is kept constant. When a cable is unwound the hydraulic motor coupled to the winch in question will function as a pump, as a result of which this exerts a certain opposing torque on said winch. The other winch will then wind at about the same speed and the hydraulic motor will be fed at least partly with the liquid lifted by the motor functioning as a pump. In order to compensate any differences in speed between the winding and the unwinding winch, means are provided to maintain the pressure in the high pressure line, which means may consist of a pump which has to have only a fairly small capacity, and an overflow valve connected in parallel with it. By using this method a pretension, that is to say, a specific minimum force, is continuously maintained on both cables independent of other forces to be exerted.

The invention furthermore relates to an installation for applying the method of hauling vessels, comprising two winch drums that can be separately driven, the cables of which can be connected with the forward end and the stern of a vessel. According to the invention each winch drum is coupled with a hydraulic motor, which is operative independently of the drum driving mechanism and the hydraulic motors are interconnected by a high and a low pressure line, and means are provided to keep the pressure in the high and the low pressure line constant.

According to the invention the low pressure line can be connected with the atmosphere through a reservoir and the high pressure line can be connected with a hydraulic pump and an overflow valve connected in parallel with it.

Another feature of the invention is that the discharge and supply side of each hydraulic motor is provided with a control valve so that the discharge and supply line of each hydraulic motor can be changed or short-circuited. When the supply or discharge line of a hydraulic motor is changed, the winch drum coupled with it will start to unwind, and the winch is driven by the hydraulic pump maintaining the pressure in the high pressure line. This may be desirable when the cable in question is secured to the vessel, which can be done in this way without it being necessary to use the main motor, if any, of the winch. In the short-circuited position of the control valve the hydraulic motor does not exert force on the winch drum in question, so that it can rotate freely.

To elucidate the invention an installation for hauling vessels will be described below with reference to the accompanying drawing.

The drawing shows schematically two winch drums 1 and 2 over which cables 3 and 4 are passed, which at the ends are secured to a vessel 5. Cables 3, 4 are guided around reversing rollers 7, 8. Each winch drum can be driven through a shaft 9, 10 and gears 11, 12 and 13, 14. At each end of each shaft 9, 10 a hydraulic pump motor 15, 16 and 17, 18 is provided. The hydraulic motors 15 and 17 are adapted to drive winch drums 1 and 2, while motors 16 and 18 have to exert continuously a specific torque on winch drums 1 and 2 independently of the driving mechanism of winch drums 1 and 2 and thus impart a certain minimum tension or pretension to cables 3 and 4.

The hydraulic driving motors 15, 17 can be fed with the aid of a hydraulic pump 19, through lines 20, 21, 22, 23. Hydraulic pump 19 can be controlled continuously and in two directions. The outgoing lines 24, 25 of pump 19 can be connected with the lines 20, 21 or 22, 23 of one of the driving motors 15 and 17 with the aid of the double three-position valve 26. By a double three-position valve is understood an assembly of two three-position valves, which can each be of the type in which in one position (indicated by A) the lines at the pump side are closed whereas the lines at the winch side are short-circuited. In position B both the lines at the pump side and the winch side are short-circuited. In position C the pump lines are directly connected to the lines in question at the winch side. In the second, neutral position of the double three-position valve the lines 20, 21; 22, 23 and 24, 25 are short-circuited so that the driving motors are freely rotatable. The winch drums can also be driven in another way, for instance mechanically.

The hydraulic system for imparting a pre-tension to cables 3, 4 or for exerting a continuous torque through shafts 9 and 10 and gears 11, 12 and 13, 14 on the respective winch drums 1 and 2 comprises a hydraulic pump 27 and an overflow valve 28 connected in parallel with it, with which the pressure in line 29 can be kept virtually constant. Furthermore there is provided a line 30 which is kept at ambient pressure through line 31 and reservoir 33. The two lines 29 and 30 can be connected with the motors 16 and 18 through lines 36, 37 and 38, 39 with the aid of three-position valves 34 and 35, while the two motors 16 and 18 can also be interconnected in that way. Each three-position valve 34, 35 can be of the type in which in a position D the lines at the pump side are directly connected with the lines in question at the winch side. In a position E the lines at the pump side are closed and those at the winch side are short-circuited. In a position F the lines at the pump side are connected crosswise with those at the winch side. In the position F the motor 18, 16 is connected with pump 27 and drivable in another direction than in position D.

In the situation shown the two motors 16 and 18 exert an equally great torque on the winch drums 1 and 2 in the winding direction of each winch drum. When, for instance, vessel 5 has to be hauled to the right-hand side as shown in the drawing, the double three-position valve 26 is set in the right-hand position (as shown) and pump 19 drives the winch drum 2 through motor 17 in such a way that it starts to wind. Hydraulic motor 18, which exerts a cooperating torque with respect to motor 17, will then operate as a motor and liquid will be transmitted from the high pressure line 29 to the low pressure line 30. At least part of the liquid in the high pressure line 29 is supplemented by hydraulic motor 16 operating as a pump, which is driven by winch drum 1 at an opposing torque, which drum makes cable 3 unwind under pre-tension when hauling to the right-hand side. Any difference in the speed of rotation between the two winch drums and the consequent difference in output of motors 16 and 18 is thus compensated by pump 27 supplying liquid or by liquid discharge through overflow valve 28. As the difference in speed of rotation between the two winch drums 1, 2 is generally small when hauling, the capacity of pump 27 can be small.

When securing cables 3, 4 to the vessel or when cables 3, 4 have to be wound or unwound separately or simultaneously, valve 26 can be set in the neutral position B, so that only the hydraulic system for keeping a tension on the cables 3, 4 by means of pump 27 can be used. The three-position valves 34 and 35 can be set in the desired position during this. When, for instance, cable 4 has to be secured to a vessel, valve 34 can be set in the neutral (central) position E, while valve 35 is set in position F. High pressure line 29 is then connected to line 39 and low pressure line 30 to line 38. Thus cable 4 will be unwound through pump 27 and motor 18 by rotation of winch drum 2. When cable 4 is sufficiently unwound, its end is secured to the vessel after which valve 35 is set in position D (position shown) so that lines 29, 38 and 30, 39 are interconnected. Cable 4 is then wound again. Such manipulations can therefore be done without using the main driving mechanism of the winch drums.

I claim:

1. A method of positioning a vessel alongside a mooring structure comprising the steps of providing two rotary hauling devices on a selective one of said vessel and said mooring structure, extending cables from said hauling devices to the other of said vessel and said mooring structure and anchoring said cables, providing each of said rotary hauling devices with a hydraulic drive motor for applying a rotary torque thereon in addition to existing drive means of said hauling devices, interconnecting the hydraulic drive motors by means of high and low pressure lines, and normally maintaining a constant pressure in each of said high and low pressure lines to apply a cable tensioning torque on both of said hauling devices.

2. The method of claim 1 wherein the vessel is hauled along the mooring structure by shortening and lengthening respective ones of the cables utilizing said hauling devices while retaining the connections between said hydraulic drive motors and the respective rotary hauling devices.

3. The method of claim 2 wherein said hauling devices are winches having drums drivable by both said existing drive means and said hydraulic drive motors.

4. The method of claim 2 wherein one of said hydraulic drive motors functions as a motor to aid in the shortening of the respective cable and the other of said hydraulic drive motors is driven by its respective hauling devices and functions as a pump to supply hydraulic fluid to said one hydraulic drive motor.

5. The method of claim 1 wherein said hauling devices are winches having drums drivable by both said existing drive means and said hydraulic drive motors.

6. The method of claim 1 wherein said hydraulic drive motors are constantly coupled to said rotary hauling devices for rotation as said rotary hauling devices are rotated.

7. A method according to claim 1 wherein the high pressure line is kept at a constant value by a pump with an overflow valve connected in parallel with it, while the low pressure line is connected to a vent reservoir.

8. Apparatus for positioning a vessel alongside a mooring structure comprising a pair of winches each including a drum, cables extending from said drums for individual shortening and loosening, each of said winches including first rotary motor means for selectively driving said drum, each of said winches including second rotary motor means for exerting a like cable tensioning torque on said drum thereof independently of said first rotary motor means to normally apply a like tensioning force on each of said cables, said second motor means being a hydraulic motor, high and low pressure lines connected to both of said second motor means, and control means maintaining a constant pressure in each of said high and low pressure lines, said control means includes a source of substantially constant pressure hydraulic fluid, identical control valves for said second motor means selectively providing for opposite directional driving of said second motor means and isolation of said second motor means from said hydraulic fluid source, and said first motor means being in the form of hydraulic motors, a separate source of hydraulic fluid under pressure, and interconnected valve means for selectively independently connecting and isolating said first motor means relative to said separate source.

9. The apparatus of claim 8 wherein said separate source is a reversible pump.

10. Apparatus for positioning a vessel alongside a mooring structure comprising a pair of winches each including a drum, cables extending from said drums for individual shortening and loosening, each of said winches including first rotary motor means for selectively driving said drum, each of said winches including second rotary motor means for exerting a like cable tensioning torque on said drum thereof independently of said first rotary motor means to normally apply a like tensioning force on each of said cables, said second motor means being a hydraulic motor, high and low pressure lines connected to both of said second motor means, and control means maintaining a constant pressure in each of said high and low pressure lines, said control means including means for connecting said second motor means high and low pressure lines directly to one another whereby when one of said winches is shortening its respective cables and the other of said winches is loosening its cable, said second motor means coupled to said other winches is driven as a pump to drive said second motor means coupled to said one winch.

11. The apparatus of claim 10 wherein said control means includes a separate pump coupled to said high pressure line to compensate for differences in the rotations of said winches.

* * * * *